US006147595A

United States Patent [19]

Kao

[11] Patent Number: 6,147,595

[45] Date of Patent: Nov. 14, 2000

[54] STRUCTURE OF BUZZER

[76] Inventor: Wen-Chuan Kao, 11F, No. 117, Tzu Cheang Road, Taoyuan, Taiwan

[21] Appl. No.: 09/397,007

[22] Filed: Sep. 15, 1999

[51] Int. Cl.[7] ..... G08B 3/00

[52] U.S. Cl. ..... 340/388.1; 340/691.1; 340/693.5; 340/391.1; 340/384.6

[58] Field of Search ..... 340/388.1, 391.1, 340/384.6, 384.1, 691.1, 693.5

[56] References Cited

U.S. PATENT DOCUMENTS 5,296,839 3/1994 Le ..... 340/384.6
5,719,549 2/1998 Lui ..... 340/384.73
5,867,090 2/1999 Chen ..... 340/388.1

*Primary Examiner*—Daryl C. Pope
*Attorney, Agent, or Firm*—Bacon & Thomas, PLLC

[57] ABSTRACT

A buzzer, which includes a casing, a diaphragm supported on an upright annular supporting flange inside the casing, and a circuit board mounted within the casing and electrically connected to the diaphragm, wherein the casing has locating ribs symmetrically disposed on the inside for the positioning of the circuit board in the casing; the circuit board has three metal contact spring elements raised from the bottom side wall thereof and respectively maintained in contact with respective conductive zones at the diaphragm, and a plurality of peripheral notches respectively matched with the locating ribs in the casing.

3 Claims, 3 Drawing Sheets

STRUCTURE OF BUZZER

BACKGROUND OF THE INVENTION

The present invention relates to buzzers, and more particularly to an improved structure of buzzer, which is easy to manufacture and, achieves high performance.

A regular buzzer, as shown in FIGS. 1 and 2, is generally comprised of a casing 7, a diaphragm 3 suspended in the casing 7, a ceramic membrane 9 adhered to the top side wall of the diaphragm 3 at the center, the ceramic membrane 9 comprising three separated conductive zones 4, 5 and 6 at the top, a circuit board 2 mounted within the casing 7 above the diaphragm 3, three enameled lead wires 1 respectively connected between the circuit board 2 and the three separated conductive zones 4, 5 and 6 at the ceramic membrane 9, and two power terminals 8 respectively raised from the circuit board 2 and extended out of the casing 7 for connection to power source. When electric current is connected to the power terminals 8, the diaphragm 3 is vibrated to produce sound. This design of buzzer has drawbacks. When soldering the lead wires to the conductive zones 4, 5 and 6 at the ceramic membrane 9, the ceramic membrane 9 tends to be damaged by heat, or by the soldering gun it self. The performance of the buzzer becomes worse if the ceramic membrane 9 breaks. Further, if the enameled lead wires are not properly curved, the enameled lead wires may touch the diaphragm 3, thereby causing the vibration effect of the diaphragm 3 to be affected.

SUMMARY OF THE INVENTION

The present invention has been accomplished to provide a buzzer, which eliminates the aforesaid drawbacks. According to the present invention, the buzzer comprises a casing, a diaphragm supported on an upright annular supporting flange inside the casing, and a circuit board mounted within the casing and electrically connected to the diaphragm, wherein the casing has locating ribs symmetrically disposed on the inside for the positioning of the circuit board in the casing; the circuit board has three metal contact spring elements raised from the bottom side wall thereof and respectively maintained in contact with respective conductive zones at the diaphragm, and a plurality of peripheral notches respectively matched with the locating ribs in the casing. Because the metal contact spring elements are respectively set into contact with the respective conducting zones at the diaphragm when the circuit board is inserted into the casing, it is not necessary to use a soldering apparatus to solder the circuit board to the diaphragm. Further, because the metal contact spring elements space the circuit board from the diaphragm, the circuit board is prohibited from direct contact with the sidewall of the diaphragm, enabling the diaphragm to be positively vibrated.

DETAILED DESCRIPTION OF THE PREFERRED EMBODIMENT

Figure 1:
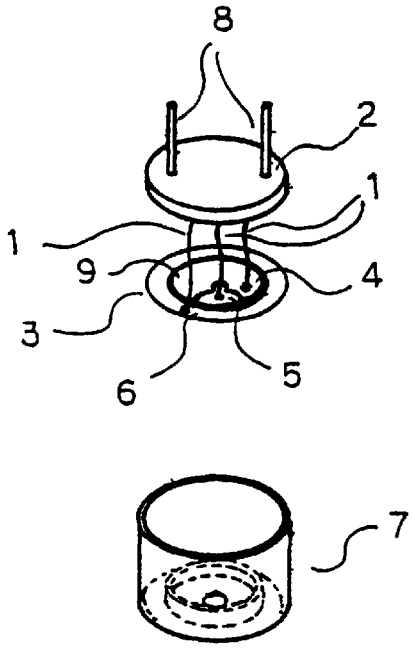
FIG. 1 is an exploded view of a buzzer according to the prior art.
Figure 2:
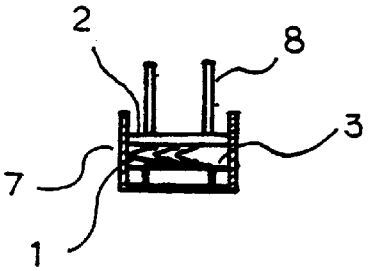
FIG. 2 is plain view showing the prior art buzzer assembled.
Figure 3A:
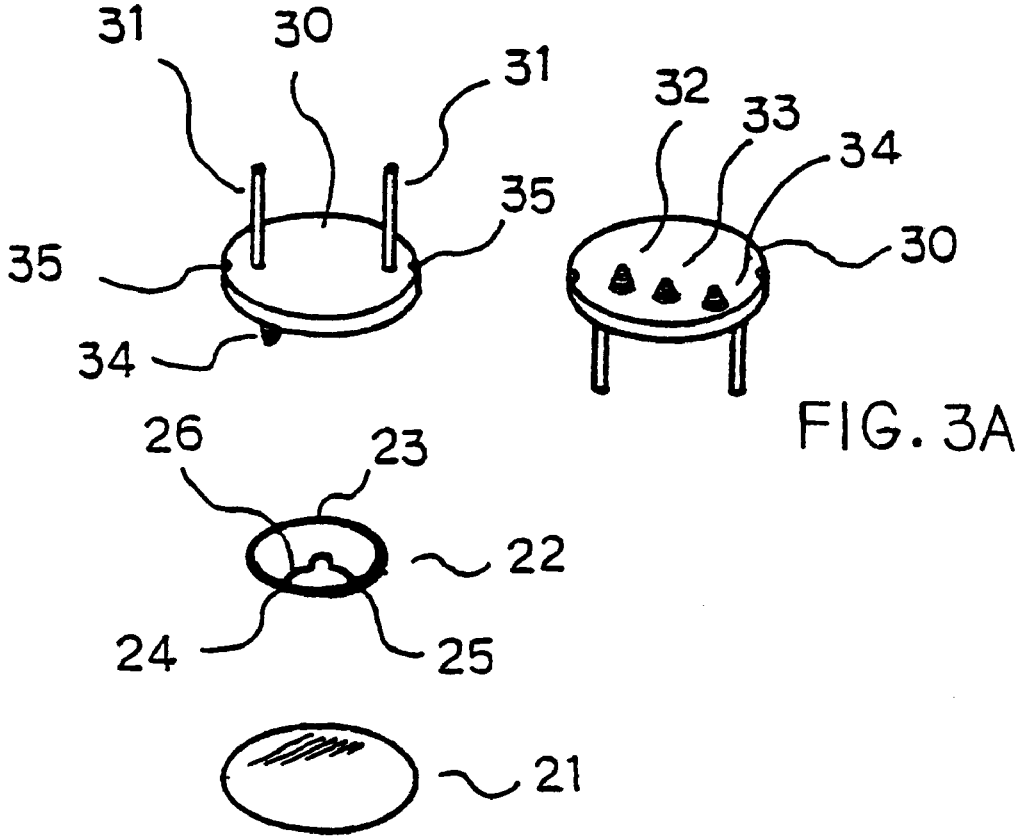
FIG. 3A is an elevational view showing the circuit board of FIG. 3 turned vertically through 180°.
Figure 3:
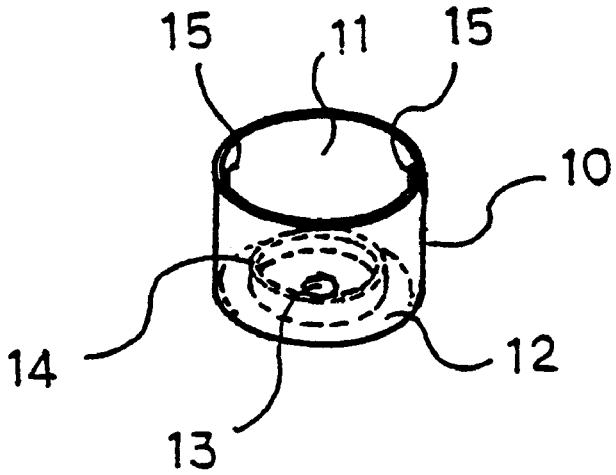
FIG. 3 is an exploded view of a buzzer according to the present invention.
Figure 4:
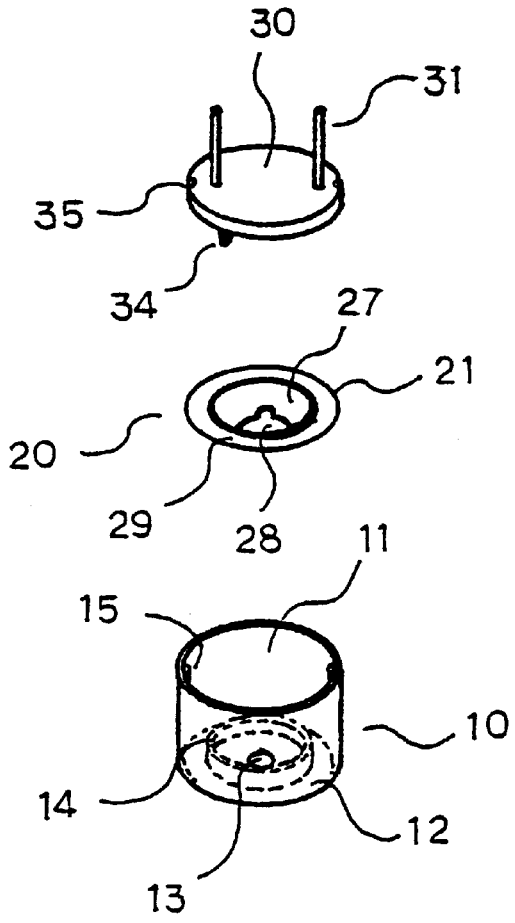
FIG. 4 is another exploded view of the present invention.
Figure 5:
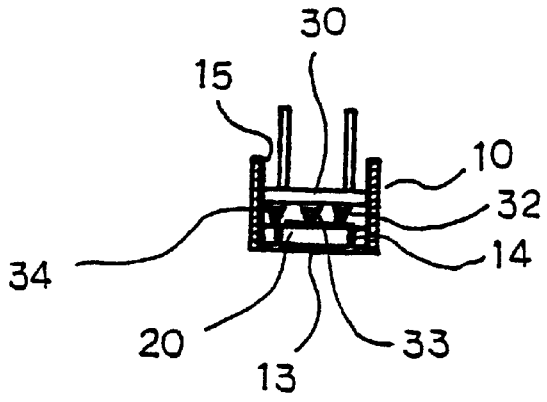
FIG. 5 is a plain view of the present invention, showing the buzzer assembled.

Referring to FIGS. from 3 through 5, a buzzer in accordance with the present invention is shown comprised of a casing 10, a diaphragm 20, and a circuit board 30. The casing 10 comprises a cylindrical open chamber 11, a bottom center hole 13 at the center of the bottom side wall 12 thereof for output of sound waves, an annular supporting flange 14 raised from the bottom side wall 12 within the open chamber 11 around the bottom center hole 13, and two locating ribs 15 bilaterally disposed on the inside near the topmost edge thereof. The diaphragm 20 is comprised of a thin circular piece of metal film 21 of diameter approximately equal to the diameter of the cylindrical open chamber 11 in the casing 10, and a ceramic membrane 22 of diameter approximately equal to the diameter of the annular supporting flange 14. The ceramic membrane 22 has a bottom side wall coated with a layer of metal coating and electrically conductively adhered to one side wall, namely, the top side wall of the metal film 21, a non-conductive peripheral line 23 around the periphery thereof, and a non-conductive curved line 26 provided at the top side wall thereof and connected between two points 24 and 25 at the peripheral line 23. The topside wall of the ceramic membrane 22, other than the non-conductive peripheral line 23 and the non-conductive curved line 26, is coated with an electrically conductive coating. After installation of the ceramic membrane 22 in the top side wall of the metal film 21, three conductive zones 27, 28 and 29 are formed on the diaphragm 20 at the top, and separated from one another by the non-conductive peripheral line 23 and the non-conductive curved line 26, and the bottom side wall of the metal film 21 is adhered to the topmost edge of the annular supporting flange 14. The diameter of the circuit board 30 is approximately equal to the diameter of the cylindrical open chamber 11 (the inner diameter of the casing 10). The circuit board 30 comprises a buzzer starting circuit (not shown) at the bottom side wall thereof, two power terminals 31 raised from the top side wall thereof, three metal contact spring elements 32, 33 and 34 raised from the bottom side wall, and two peripheral notches 35 corresponding to the locating ribs 15 at the casing 10.

The circuit board 30 is put into the cylindrical open chamber 11 inside the casing 10, enabling the three metal contact spring elements 32, 33 and 34 to be maintained in contact with the three conductive zones 27, 28 and 29 at the diaphragm 20 respectively. By means of aiming the peripheral notches 35 at the locating ribs 15, the circuit board 30 can easily be inserted into the cylindrical open chamber 11 in the casing 10, and set into position. The design of the locating ribs 15 at the casing 10 and the design of the peripheral notches 35 at the circuit board 30 enable the circuit board 30 to be quickly installed in the casing 10 by a machine without the use of a soldering apparatus. Because no soldering apparatus is used when connecting the circuit board 30 to the diaphragm 20, installation of the circuit board 30 does not cause the diaphragm 20 to break.

Because the circuit board 30 is electrically connected to the conductive zones 27, 28 and 29 at the diaphragm 20 by the metal contact spring elements 32, 33 and 34, the metal contact spring elements 32, 33 and 34 prohibit the circuit board 30 from direct contact with the topside of the diaphragm 20. In order to achieve high performance, the metal coating at the ceramic membrane 22 is preferably obtained from silver. Further, the metal contact spring elements 32, 33 and 34 are preferably of metal spiral springs.

While only one embodiment of the present invention has been shown and described, it will be understood that various modifications and changes could be made thereunto without departing from the spirit and scope of the invention disclosed.

I claim:

1. A buzzer comprising:

a casing, said casing comprising a cylindrical open chamber, a bottom center hole at the center of a bottom sidewall thereof for output of sound waves, and an annular supporting flange rose from the bottom sidewall within said open chamber around said bottom center hole;

a diaphragm mounted inside said cylindrical open chamber of said casing and fixedly supported on said annular supporting flange, said diaphragm comprised of a thin circular piece of metal film fixedly supported on said annular supporting flange, and a ceramic membrane adhered to said circular piece of metal film, said circular piece of metal film having a diameter approximately equal to the diameter of said cylindrical open chamber, said ceramic membrane having a diameter approximately equal to the diameter of said annular supporting flange, said ceramic membrane having a bottom side wall coated with a layer of metal coating and electrically conductively adhered to said metal film, a non-conductive peripheral line around the periphery thereof, and a non-conductive curved line provided at a top side wall thereof and connected between two points at said peripheral line, said non-conductive peripheral line and said non-conductive curved line separating said ceramic membrane and said metal film into three conductive zones; and a circuit board mounted in said cylindrical open chamber inside said casing, said circuit board having a diameter approximately equal to the diameter of said cylindrical open chamber, said circuit board comprising a buzzer starting circuit at a bottom side wall thereof, two power terminals raised from a top side wall thereof for connection to power supply;

wherein said casing comprises a plurality of locating ribs symmetrically disposed inside said cylindrical open chamber for the positioning of said circuit board in said casing; said circuit board comprises three metal contact spring elements raised from the bottom side wall and respectively maintained in contact with the conductive zones at said diaphragm, and a plurality of peripheral notches respectively matched with the locating ribs at said casing for positioning.

2. The buzzer of claim 1 wherein the metal coating of said ceramic membrane is preferably obtained from silver.

3. The buzzer of claim 1 wherein said metal contact spring elements are metal spiral springs.

* * * * *